US007118516B1

(12) United States Patent
Gouthro

(10) Patent No.: US 7,118,516 B1
(45) Date of Patent: Oct. 10, 2006

(54) MARTIAL ARTS TRAINING DEVICE

(76) Inventor: William Ashley Gouthro, 19118 SW. 13 Ave., Newberry, FL (US) 32669

( * ) Notice: Subject to any disclaimer, the term of this patent is extended or adjusted under 35 U.S.C. 154(b) by 144 days.

(21) Appl. No.: 10/825,052

(22) Filed: Apr. 16, 2004

(51) Int. Cl.
*A63B 21/00* (2006.01)
*A63B 71/00* (2006.01)
*A63B 21/06* (2006.01)

(52) U.S. Cl. ..... 482/92; 482/93; 482/139; 482/148; 602/20

(58) Field of Classification Search ..... 482/121, 482/49, 105, 124; 601/33, 34, 123, 143, 601/21, 22, 62, 64; 2/16, 20; 128/878, 880; 602/4
See application file for complete search history.

(56) References Cited

U.S. PATENT DOCUMENTS 2,553,277 A * 5/1951 Robinson et al. ..... 601/40
3,519,269 A 7/1970 Howlett et al.
3,608,900 A 9/1971 Welch
4,059,265 A 11/1977 Wieder
4,328,964 A 5/1982 Walls
4,544,155 A 10/1985 Wallenbrock et al.
4,660,550 A * 4/1987 Bodine ..... 602/16
4,685,671 A 8/1987 Hagerman et al.
4,733,862 A 3/1988 Miller
4,960,114 A * 10/1990 Dale ..... 602/21
5,013,035 A 5/1991 Nathaniel
5,078,388 A * 1/1992 Dempsey, Jr. ..... 482/49
5,167,601 A 12/1992 Frappier
5,176,602 A 1/1993 Roberts
5,358,471 A * 10/1994 Klotz ..... 602/21
5,366,426 A 11/1994 Glavin
5,372,565 A 12/1994 Burdenko
5,458,564 A * 10/1995 Franzen ..... 602/21
5,490,823 A 2/1996 Awbrey et al.
5,518,480 A 5/1996 Frappier
5,558,607 A 9/1996 Darling
5,595,559 A 1/1997 Viel
5,624,360 A 4/1997 Wilkins
5,643,159 A 7/1997 Iavarone
5,993,362 A 11/1999 Ghobadi
6,013,044 A * 1/2000 Estwanik ..... 602/64
6,228,004 B1 * 5/2001 Steinbach et al. ..... 482/121
6,945,945 B1 * 9/2005 Givler et al. ..... 602/20

* cited by examiner

*Primary Examiner*—Danton D. DeMille
*Assistant Examiner*—Allana Lewin
(74) *Attorney, Agent, or Firm*—Sven W. Hanson

(57) ABSTRACT

The present devices apply resistance force to a user's body in close simulation of the impact and resistive forces experienced in martial arts techniques and interactions to provides more effective muscle and neurological training of the user. The devices include a conformable grip that accepts a user's fist for directing resistive force in a distributed manner to the outside surface of the user's fist. Flexible straps extend from the side of the grip to be positioned, in use, on the sides of a user's arm. The straps are connected by additional cross-straps to allow for transfer of force to the user's forearm. The configuration of straps allows transfer of varying proportions of the resistive force to the fist, and separately, the forearm. A system for physical training includes a resistance device.

10 Claims, 3 Drawing Sheets

41
40

AN
26
TW
TM
22
20
TL
24
BM
FL
50
11
10
2B
2C
BW
14
BL
W

MARTIAL ARTS TRAINING DEVICE

BACKGROUND OF THE INVENTION

The present invention pertains to devices for human muscle and neurological training using external mechanical resistance. Particularly, the invention pertains to devices for resistance training for martial art and other combative techniques.

Herein, "martial art" means the group of various combative and defensive body strikes and blocks that are defined in the forms of Oriental based physical and self-defense arts commonly referred to as karate, kung-fu, tae kwon do and the like. A feature distinction of the martial arts over what may be termed "Western" combative modes is the varied and more complex motions of the human body in martial arts. In general, the entire body is moved in integrated modes with one or more points of interaction with an opponent. Importantly, in each mode or action, the relative angular orientations, angular motions, and linear motions of the individual's body parts may change during a single action. Each mode or action requires a different combination or sequence of relative body orientations and motions. To successfully learn and employ the actions and methods of the martial arts requires more than strength and speed. These modes must be not only understood, but also developed into the muscle and neural patterns of the body. This requires highly repetitive and precise muscular and neural training. The precise movements of the body must be patterned and repeated many times to develop an individual's body to respond and act in the necessary and desired manner.

Prior art resistance strengthening devices and systems are generally one-dimensional and linear in that, during training, the particular muscles and muscle groups that are enervated in an exercise do not change during the exercise and their relative interactions do not change. The only change is the level of effort and the extent of motion along a single axis or line of action. This is in part, due to the objective of most prior art devices, which is simple strength training or simple muscle development with the expected outcome of strength development carrying over to performance of the sport or other subject activity. But this type of training is inadequate to simulate the complex motions of the martial arts. What is needed is a device to provide resistance training while allowing a user to repeat the precise muscle patterns used in martial arts actions.

SUMMARY OF THE INVENTION

The present invention is a device and system for physical athletic training of the human body. In particular, the construction of the invention allows for resistance forces to be applied to a user's body in close simulation of the impact and resistive forces experienced in actual martial arts techniques and interactions. This close simulation provides for a more effective muscle and neurological training of the user's body as is required for the complex martial arts techniques.

The device includes a conformable grip for accepting a user's hand held in a fist for directing or channeling resistive force in a distributed manner to the outside surface of the user's fist. Flexible longitudinal straps are positioned on opposing sides of the grip to be positioned, in use, on the sides of a user's arm and are connected to the grip to transfer resistive force. The straps are connected by additional cross-straps to allow for transfer of force to the user's forearm. The configuration of longitudinal and cross straps allows transfer of varying proportions of the resistive force to the fist, and separately, the forearm. This allows training of all the muscles used in martial art techniques.

For best effect, the cross-straps should be separated a distance from the grip to bear on the user's forearm in a effective attitude. The arrangement of the straps encircle an user's arm when the grip is fitted to a user and allow the respective user's arm upper arm and shoulder to move between medial and lateral longitudinal straps. The dimensions and location of the straps may varying depending upon a user's body dimensions.

Resistance force is provided by any of several resistance device known in the art, including weight and elastic member based systems. A training systems according to the invention includes one or more grips and a resistance device. Methods of the invention include training modes in which resistance force is applied to a user's body in the manner as provided by the inventive device.

Additional features and novel characteristics of the invention are provided in the following details of preferred embodiments and the accompanying drawings and claims.

DESCRIPTION OF THE PREFERRED EMBODIMENTS

Figure 1:
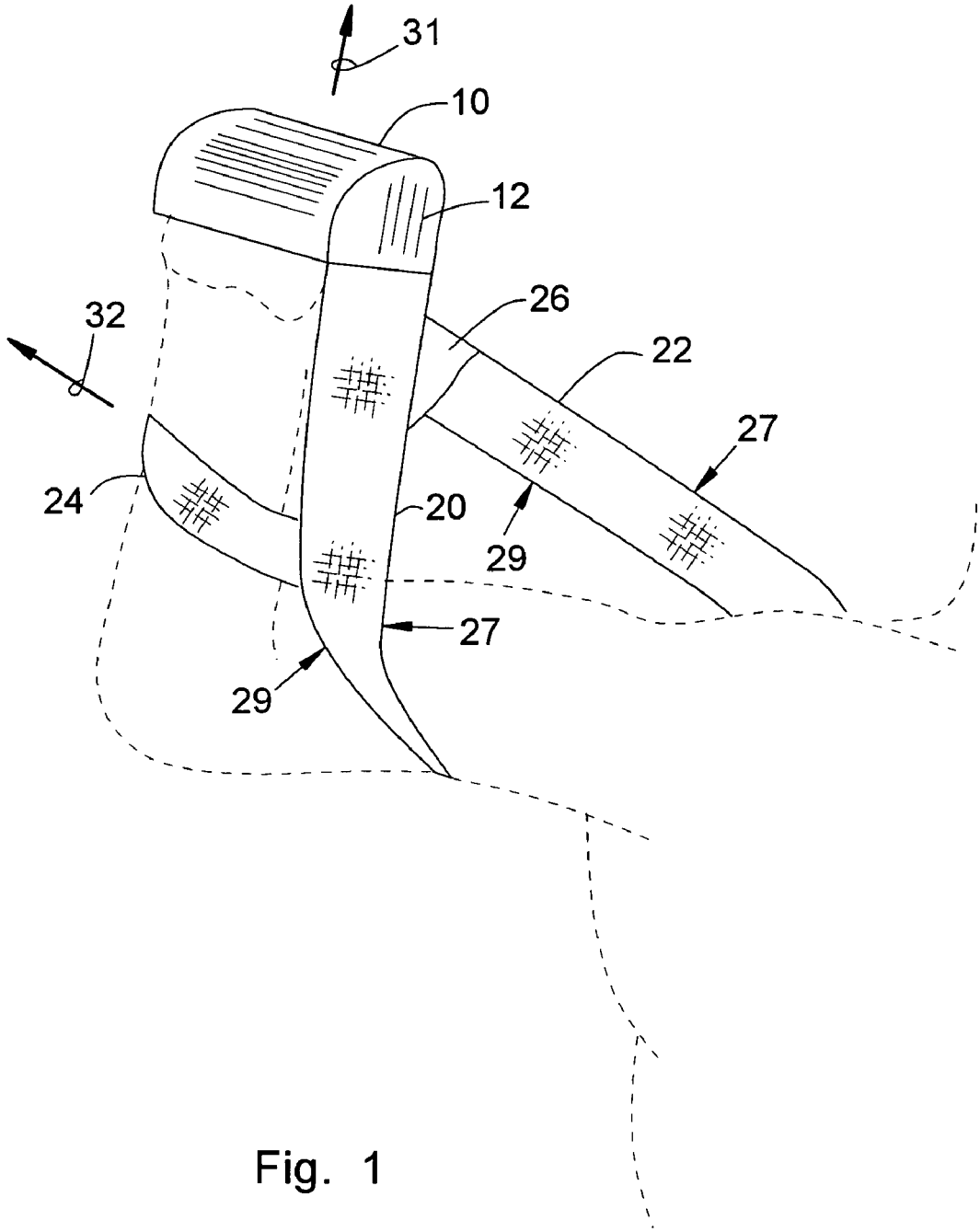
FIG. 1 is a perspective view of one embodiment of the invention as used.

FIG. 1 is a perspective view of one embodiment of the inventive device fitted to the right hand and arm of a user and deployed as intended in one inventive method. The device includes a leather pocket-like grip 10 configured to accept and conformably enclose a user's closed fist. From a lateral side 12 of the grip 10 extends an elongated and flexible lateral strap 20. On the opposite, medial, side of the grip 10 a similar medial strap 22 also extends in like manner. Herein, the terms "lateral" and "medial" are intended to convey their conventional anatomical meanings. The relative orientation of the lateral and medial straps 20, 22 to the grip 10 allows the straps and grip to provide resistance to motion of an engaged user's arm and fist in a variety of attitudes and directions and during changing direction of motion. In FIG. 1, the motion of the user's fist is resisted on upward and outward directions along a longitudinal axis of the arm. This direction and longitudinal axis coincides with a normal 31 to the plane of the flexed fingers and knuckles of the user's fist when engaged with the grip 10. At the same time, resistance to lateral motion 32 may also be asserted to the arm by the transfer of resistive force from the straps to the grip 10 and also to cross straps as shown.

Flexible lower and upper cross straps 24 and 26 connect the medial and lateral straps at top and bottom edges 27, 29 respectively. The cross-straps 24, 26 are connected to the lateral and medial straps 20, 22 a distance separated from the grip 10 so as to bear on the user's forearm and provide balanced transverse resistance to the forearm during use. In FIG. 1, the user's arm is bent at the elbow and thrust outward. The arm's motion 32 is resisted by the grip's bearing on the fist and the bottom cross strap 24 bearing on the forearm. Combined, these bear on the user's arm in varying manner to allow three-dimensional and changing resistance loading during the complex movements of martial art techniques. The top cross-strap 26, in the use shown, limits relative separation of the lateral and medial straps to help control the direction of resistive force of the straps. The respective resistances provided by the grip 10 and the cross-strap 24 or 26 may vary depending upon the angular orientation and motion of the user's arm in practice. The nature of the resistance applied to the arm will change with the relative a user's elbow angle, forearm rotation, wrist angle, shoulder angles, and shoulder rotation. For example, from the condition shown in the figure, if the user extends his arm completely and aligns it parallel with, and between, the lateral and medial straps 20, 22, the cross straps 24, 26 will be eventually unloaded and the resistive force provided solely to the fist through its bearing on the grip 10. If, alternatively, the user bends his arm to a greater degree, more resistance will be transferred through the cross straps to the user's forearm. Note that the ability to apply concentric loads to both the fist and the forearm is a result of the construction having the two separated medial and lateral straps aligned on opposite sides of the mid plane of the arm, the straps jointly providing a balanced resistive force.

The proximal ends of the medial and lateral straps are not shown in FIG. 1 but are connected (behind the user as shown) to a resistance device. Resistance may be provided by any of a variety of systems previous known in the art, including for example, but not limited to: weights, elastic band elements, visco-elastic systems, mechanical springs, and like devices.

Figures 2A, 2B, 2C:
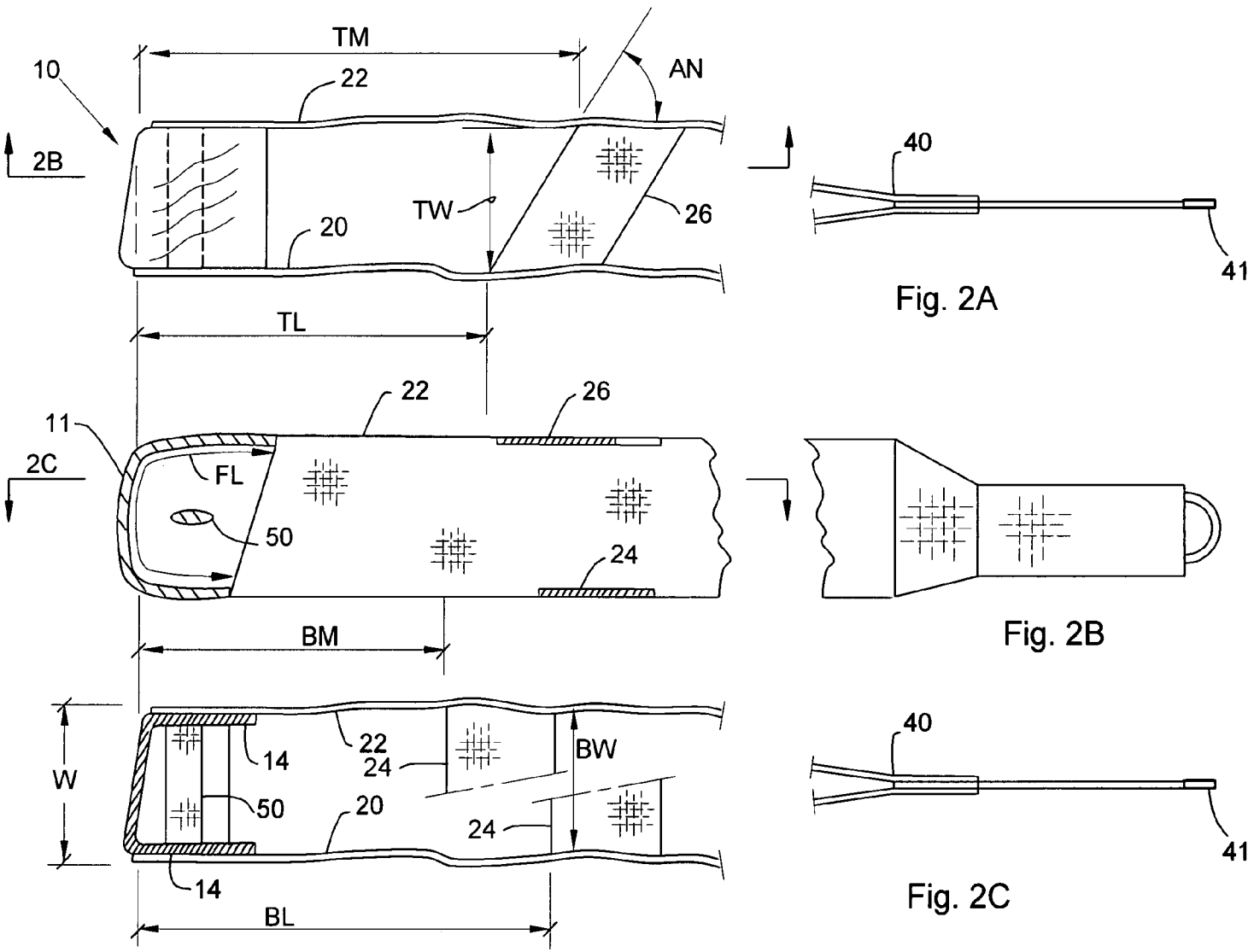
FIGS. 2A, B, and C are top plan, side section, and plan section views of one embodiment of the invention.

FIGS. 2A, 2B and 2C depict one embodiment of the device in various views to illuminate a preferred construction. Although only a right-hand device is shown, left-hand devices are constructed similarly and pairs of devices fitting, respectively, both right and left hands are preferably provided as a set. To provide for a convenient drawing scale for the figures, each strap in the figures is shown cut away and its length shortened. A lateral strap 20 and a medial strap 22 are cojoined at respective strap proximal ends 40. A means for connecting the straps to a resistance device or system may be secured to the proximal ends 40. In the embodiment shown, this element is a flexible leash strap terminating in a conventional rigid "D" ring 41. Alternatively, each strap may be separated secured to a resistance device.

Both the medial and lateral strap extend respective lengths from the proximate ends 40 to connect to the sides of a grip 10. The meaning of the term "side" or "sides" is with respect to the intended configuration as engaged to a person's arm having medial and lateral sides in the anatomical sense. The grip 10 is configured to accept and conformably enclose a user's closed fist to transmit resistive force from the straps to the outside (posterior surface) of the user's hand and knuckles. It is important that the resistive force be transmitted to the hand and knuckle in this distributed manner to reproduce the load path through the body occurring in actual martial art activities. In contrast, use of a rigid handle which contacts primarily the palm portion of a user's hand, as used in many prior art resistive training devices, provides a distinct and inaccurate load path and consequently improper muscle and nerve training from their use.

In the embodiment of the figures, the grip 10 includes a facing element 11 extending between the medial and lateral straps and separating them. The grip 10 has a generally "C" shape in cross section (as in FIG. 2B) to wrap over the top, front, and bottom of the extended (palm down) fist of a user. Preferably, the grip 10 is formed of a single piece of leather, cut and joined at seams, to provide a facing element 11 and distinct side portions 14 to which the straps are attached. Use of leather or similar thick sheet materials provides a stiff yet conforming grip that enables distribution of force from the straps to the user's fist. Heavy weight, or multiple layer, woven fabric or rubber reinforced cloth may alternatively be used if sufficiently strong. In alternative embodiments, the grip 10 may be formed of molded rubber or plastic. Such a construction may have facing elements and side portions which are indistinct, although such a grip as an integral unit provides structure serving the same purpose of distributing the resistance force to the fist.

To ensure distributed transfer of resistive force in all modes of use, the grip should bear on the user's fist on a maximum of the hand surface. When fitted to a user's hand, the facing element 11 should extend from just forward of the user's wrist, and wrapping around the clenched fingers an inside length FL, to extend to just beyond the extended thumb knuckle. The dimension FL is measured along a longitudinal vertical midplane of the facing element 11. For the same reasons, the facing element is oriented at a slight angle. This is to assist in forming the user's fist in a condition with the larger knuckles forward which is preferred. To ensure this angular configuration, with the large knuckles forward, the lateral strap 20 is slightly longer than the medial strap 21. If cojoined at a proximal end as shown in the figures, the lateral strap 20 should be 0.5 to 0.75 inch longer than the medial strap for this purpose. This presumes that the straps extend to the distal extreme of the adjacent facing element, and hence to the user's knuckles.

Extending between the opposing side portions 14, inside the grip, is a flat clench strap 50. The clench strap 50 is a may be leather, fabric or woven strapping secured to the inside surfaces of the opposing side portions 14, slightly offset from the inside of the most distal extent of the facing element 11. The offset distance should be sufficient to allow a user's fingers to be inserted around the clench strap 50. This offset distance is preferably in a range of 0.5 to one inch, varying somewhat with the presumed size of the user's hand and fingers. The size and width of the clench strap should be such as to comfortably be clenched in a user's fist without displacing the fingers from a closed fist configuration. The clench strap 50 should be about 0.75 to 1 inch wide. The clench strap has at least two functions: 1) to encourage the user's to maintain a closed fist in use by providing a tactile stimulation and 2) to provide a connection between the hand and grip for twisting motions. A rigid clench strap is not suggested as rigidity will transfer a too much force and not allow the resistance force to be transferred to the outside of the fingers and knuckles of the fist as desired.

By incorporating the two effectively parallel straps (medial and lateral) oriented closely to the sides of the arm and hand, the present device allows resistive force to be applied to the user in multiple attitudes without creating appreciable twisting moments on the arm. At the same time, the user's arm is allowed a great range of motion. As seen in FIG. 1, the user's arm is allowed to move between the medial and lateral straps when the user's arm is bent at the elbow. The lower cross-strap 24 and grip 10 together transfer the resistive force from both the medial and lateral straps 20, 22. The resultant forces on the arm are without appreciable torsion on the arm or shoulder. Because the cross-straps, together with the medial and lateral strap, create a closed loop, encircling the arm in use, the medial and lateral straps are retained in all attitudes adjacent the forearm thereby always directing the resistive force through the forearm, and hand.

To allow the desired freedom of motion while maintaining the correct force transfer, the length of the medial and lateral straps and the location and length of the cross-straps must be proper. The medial and lateral straps must be at least long enough (from grip to proximal end) to allow full extension of the arm and insertion of the upper arm and shoulder between the straps. The lower cross-strap 24 should be located separated longitudinally relative to the grip to apply force to the approximate center of a user's forearm. In the figures, the lower cross-strap intersects and joins the medial and lateral straps at, preferably, right angles locally at their respective connections. In FIG. 2C it can also be seen that the lower cross-strap connects to the medial and lateral straps 20, 22, respectively at different spacings relative to the grip 10. This configuration has been found to provide the best angle for transfer of load to the arm during bent-arm thrust motions. Because the lower cross-strap 24 must accommodate the bent forearm is a thrust attitude (see FIG. 1) its length is preferably significantly longer than the upper cross-strap 26.

The upper cross-strap must be near enough to the grip to allow the elbow to pass between the medial and lateral strap. At the same time, the upper cross-strap must be spaced distant enough from the grip to help balance the resistive forces of the medial and lateral straps when the user's arm is bent. The upper cross-strap also preferably intersects the medial and lateral straps at an angle AN of 45 degrees at their respective connections as shown in FIG. 2A. This creates an offset between the attachment to the medial and lateral straps which provides the best balance of forces. Specific device strap locations and dimensions will vary, in various configurations, to suit the size of the user's body dimensions. The below table—"Exemplary Device Dimensions"—provides complementary dimensions for a number of useful device embodiments based on various exemplary human body sizes.

TABLE 1

Exemplary Device Dimensions

| Parameter | Nominal Dimension (inches) | Variation +/− (inches) |
|---|---|---|
| W - grip width | 4.5 | 1.0 |
| FL - facing length | 7 | 1.0 |
| TM - top cross-strap location/medial | 8 | 1.0 |
| TL - top cross-strap location/lateral | 6.5 | 1.0 |
| TW - length of upper cross-strap (separation between med and lat. straps) | 2.25 | 0.5 |
| H - height of the grip = height of medial and lat. strap at junction with grip | 2 | 1.0 |
| BM - bottom cross-strap location/medial | 6 | 1.0 |
| BL - bottom cross-strap location/lateral | 9.25 | 1.0 |
| BW - length of bottom cross-strap | 8 | 1.0 |
| Open Length (minimum) | 24–30 | |

The dimension reference characters in the table are relative to those shown in FIGS. 2A, 2B, and 2C. Note that the locations of the cross-straps (TM, TL and BM, BL) are given relative to the distal edge of the cross-straps. The lengths of the cross-straps TW and BW are actually given as the perpendicular distance between the medial and lateral straps at the location of the cross-strap. The dimensions given in the table are nominal dimensions for a medium sized device. Various sizes to fit adults and youths are contemplated that may have dimensions which vary from the nominal by the given variation (+/−) amounts.

The cross-straps' width is preferably about two inches. The height of the medial and lateral straps is preferably equal the height of the grip—2 inches nominally. If the medial and lateral straps are connected at the proximal end, as shown in the figures, the strap overall longitudinal open length, from the proximal end to the most distal point of the facing element 11, should be at least in the range of minimum length provided in the table to ensure full movement of the user's arm without jamming of the proximal end against the user's shoulder. The particular length is in part a function of the human body dimensions, with the smaller range values applicable to youth sizes and the larger range values applicable minimum dimensions for adults.

Preferably, the straps are constructed of flat woven fabric strapping material such as commonly available nylon materials. The flat and wide construction of the straps as described provide smooth movement of the straps against the arm and smooth transition between angular positions. Strap widths less than one inch is not suggested for this reason. Alternatively, the straps may be constructed of leather or other flexible yet strong materials capable of maintaining tension loads. The straps may be covered with foam or other padding or a loose fabric covering to soften the contact on the skin. Hard or rounded materials such as rope are not suggested as these do not transfer load to the arm properly and are quite uncomfortable when contacting the skin in actions where there is relative movement such as in the present invention. Preferably, the straps are not of an elastic nature such as natural rubber. The straps and grip elements may be joined by any of variety of conventional methods, including, for example, stitching and adhesives; the preassembled pieces provided additional length for joining purposes.

Figure 3:
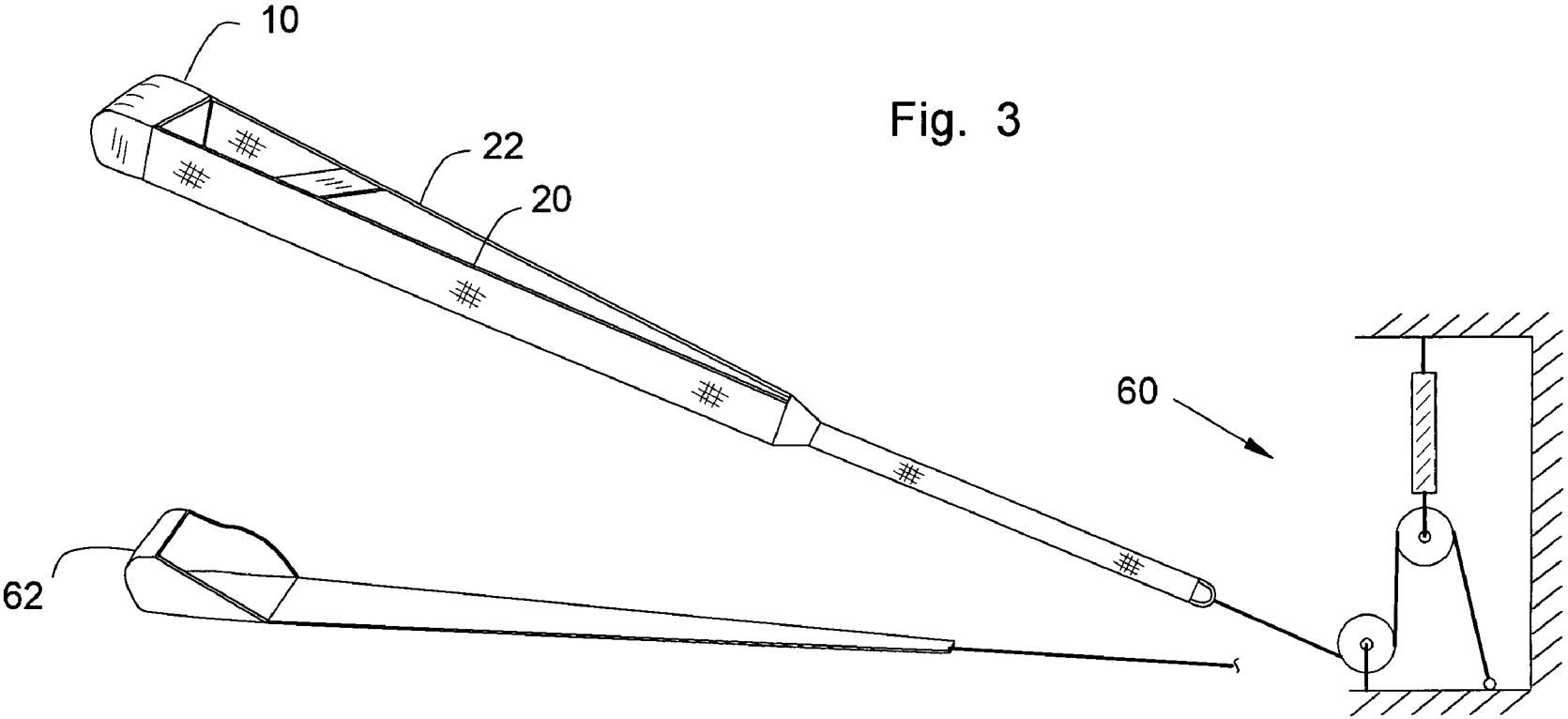
FIG. 3 is an illustration of an exercise system according to the invention and including a resistive element.

FIG. 3 depicts a novel training system including the embodiment of FIG. 1. A grip element such as described is connected by lateral and medial straps 20, 22 through a tension member, such as rope, to a resistance device 60. In the embodiment shown, the resistance device is a series of pulleys attached to an elastic member as the resistance creating element. Other means and methods of providing resistance to the tension member are contemplated. Preferably, a training system of the invention includes additional training devices, such as the foot stirrup grip 62 shown, which are similarly attachable to the same resistance device.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. A physical training device for applying resistance forces to the human body in varying modes of movement for simulating martial arts techniques, the device comprising:

a conformable grip configured to accept a human hand formed in a fist, the grip having a medial and lateral side;

a flat elongated flexible medial strap extending from the grip medial side to a respective strap end;

a flat elongated flexible lateral strap extending from the grip lateral side to a respective strap end;

a flexible clench strap within the grip and extending from the medial side to the lateral side;

a top cross-strap distanced from the grip and extending between the medial strap and the lateral strap; and a bottom cross-strap distanced from the grip and extending between the medial strap and the lateral strap; and wherein:

the grip has a most distal point for receiving the knuckles of a user's fist; and the medial and lateral straps each have an open length of at least 24 inches from the most distal point.

2. A device according to claim 1, and further comprising:

a resistance device attached to the medial and lateral strap to apply resistive force to the grip.

3. A device according to claim 2, wherein:

the resistance device comprises at least one elastic member.

4. A device according to claim 1, and wherein:

the top cross-strap has a length, between the medial and lateral straps, of 2.25 inches.

5. A device according to claim 4, and wherein:

the bottom cross-strap has length, between the medial and lateral straps, of 8 inches.

6. A device according to claim 1, and wherein:

the grip has a most distal point for receiving the knuckles of a user's fist; and the top cross-strap is distanced from the most distal point a dimension of 6.5 inches at the lateral strap.

7. A device according to claim 6, wherein:

the top cross-strap extends from the lateral strap at a 45 degree angle away from the grip and to the medial strap.

8. A device according to claim 1, wherein:

the medial and lateral straps each comprise woven fabric material having a width of two inches.

9. A physical training device for applying resistance forces to the human body in varying modes of movement for simulating martial arts techniques, the device comprising:

a conformable grip configured to accept a human hand formed in a fist;

an elongated flexible medial strap and an elongated flexible lateral strap extending from opposite sides of the grip;

a clench strap within the grip and extending from the medial side to the lateral side;

a top cross-strap connecting the medial strap and the lateral strap;

a bottom cross-strap connecting medial strap and the lateral strap;

all the straps configured to allow a person's hand to be held within the grip while the person's associated arm is disposed between the medial strap and the lateral strap and between the cross-straps, with the medial and lateral straps extending adjacent the person's arm from the grip to the person's elbow and further extending to behind the person's respective shoulder.

10. A device according to claim 9, and wherein:

the medial and lateral straps have an open length of at least 24 inches.

* * * * *